US007427964B2

(12) United States Patent
Sergi

(10) Patent No.: US 7,427,964 B2
(45) Date of Patent: Sep. 23, 2008

(54) CENTER FED HALF WAVE DIPOLE ANTENNA SYSTEM

(76) Inventor: Paul D. Sergi, 2570 Major Rd., Peninsula, OH (US) 44264

( * ) Notice: Subject to any disclaimer, the term of this patent is extended or adjusted under 35 U.S.C. 154(b) by 393 days.

(21) Appl. No.: 11/414,778

(22) Filed: May 1, 2006

(65) Prior Publication Data

US 2006/0262025 A1 Nov. 23, 2006

Related U.S. Application Data

(60) Provisional application No. 60/682,443, filed on May 19, 2005.

(51) Int. Cl.
*H01Q 1/12* (2006.01)

(52) U.S. Cl. ..... 343/793; 343/792.5; 343/815; 343/818; 343/834; 343/878

(58) Field of Classification Search ..... 343/792.5, 343/793, 815, 817, 818, 834, 878
See application file for complete search history.

(56) References Cited

U.S. PATENT DOCUMENTS 3,550,143 A * 12/1970 Grant ..... 343/792.5
3,789,416 A * 1/1974 Kuecken et al. ..... 343/792
6,028,563 A * 2/2000 Higgins ..... 343/797
7,019,979 B2 * 3/2006 Wang et al. ..... 361/719
7,183,993 B2 * 2/2007 Dai et al. ..... 343/795
7,205,953 B2 * 4/2007 Knadle et al. ..... 343/792.5

OTHER PUBLICATIONS

"Insulators for wire antennas", one page, Feb. 2006.
"Ladder Line Center Insulator", Radioware & Radio Bookstore, one page, Feb. 2006.
"*The* Alternative Multi-Band Solution", Granite State Antenna, Northwood, New Hampshire, 1 page, Feb. 2006.

* cited by examiner

*Primary Examiner*—Douglas W. Owens
*Assistant Examiner*—Chuc Tran
(74) *Attorney, Agent, or Firm*—Renner, Kenner, Greive, Bobak, Taylor & Weber

(57) ABSTRACT

A center fed half-wave dipole antenna system includes first and second end brackets that are separated by a center bracket. The center bracket and each of the end brackets include a plurality of electrically isolated terminals allowing the center bracket to be coupled to each of the end brackets via a pair of dipole lines that may contain multiple dipole wires. As such, the antenna system is able to increase the effective length of the dipole antenna in a reduced amount of space, thus reducing the mounting area requirements of the antenna system.

12 Claims, 2 Drawing Sheets

CENTER FED HALF WAVE DIPOLE ANTENNA SYSTEM

CROSS-REFERENCE TO RELATED APPLICATION

This application claims the benefit of U.S. Provisional Application No. 60/682,443, filed May 19, 2005.

TECHNICAL FIELD

This invention relates to a center fed dipole antenna. More particularly, this invention relates to a system of brackets which carries the wires for such an antenna.

BACKGROUND OF THE INVENTION

In order for a typical dipole antenna to achieve a desired resonant frequency, the dipole must take on a physical dimension proportional to the wavelength for which the antenna is to be used. Thus, in the case of half-wave dipole antenna, the length of the dipole is generally configured to be half the wavelength of the signal to be transmitted or received. As a result, if the dipole antenna is used in association with signals having a very low frequency, corresponding to a long wavelength, then the dipole would have physical proportions that are very large. However, these physical proportions necessitated by the operation of the half-wave dipole antennas are often in conflict with the dimensions of the area in which the dipole is to be mounted. Thus, there is a need for a center fed half wave dipole antenna that can achieve a desired resonance frequency, with a dipole having a reduced length.

DISCLOSURE OF THE INVENTION

It is thus an object of the present invention to provide a center fed half wave dipole antenna system that can achieve a desired resonance frequency with a dipole having a reduced length.

It is another object of the present invention to provide a bracket system that provides a plurality of slots to provide support to one or more dipole lines that are mounted between the individual brackets of the bracket system.

These and other objects of the present invention, as well as the advantages thereof over existing prior art forms, which will become apparent from the description to follow, are accomplished by the improvements hereinafter described and claimed.

In general, a dipole antenna system to mount a feedline made in accordance with one aspect of the present invention includes a center bracket having a first, a second, a third, and a fourth electrically isolated bracket terminals. A first and a second end bracket have a first and a second electrically isolated end terminals. A feed line has a first feed wire coupled to the first bracket terminal, and a second feed wire coupled to the third bracket terminal. A first dipole line has a first dipole wire connected between the first end terminal of the first end bracket and the first bracket terminal, a second dipole wire connected between the first end terminal of the first end bracket and the second bracket terminal, and a third dipole wire connected between the second end terminal of the first end bracket and the second bracket terminal. A second dipole line has a first dipole wire connected between the first end terminal of the second end bracket and the third bracket terminal of the center bracket, a second dipole wire connected between the first end terminal of the second end bracket and the fourth bracket terminal, and a third dipole wire connected between the second end terminal of the second end bracket and the fourth bracket terminal.

In accordance with another aspect of the present invention, a dipole antenna system adapted for coupling to a feed line includes a center bracket having at least two electrically isolated bracket terminals. A first and a second end bracket each have at least one electrically isolated end terminal, and a notched slot. A first dipole line extends between one of the bracket terminals of the center bracket and the end terminal of the first end bracket. A second dipole line extends between the other bracket terminal of the center bracket and the end terminal of the second end bracket, such that each of the dipole lines pass through the slots and the notches of the end brackets.

In accordance with yet another aspect of the present invention, a dipole antenna system includes a first and a second dipole line, a center bracket, and a first and second end bracket. The first and second end brackets include first and second spaced slots disposed at one end of each of the end brackets, and an aperture at the opposite end of each end bracket. A notch is disposed in one of the spaced slots. The first end bracket is coupled to the center bracket by the first dipole line, while the second end bracket is coupled to the center bracket by the second dipole line, such that the first and second dipole lines pass downward through the first slot, and upward through the second slot.

A preferred exemplary center fed half wave dipole antenna system incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 3:
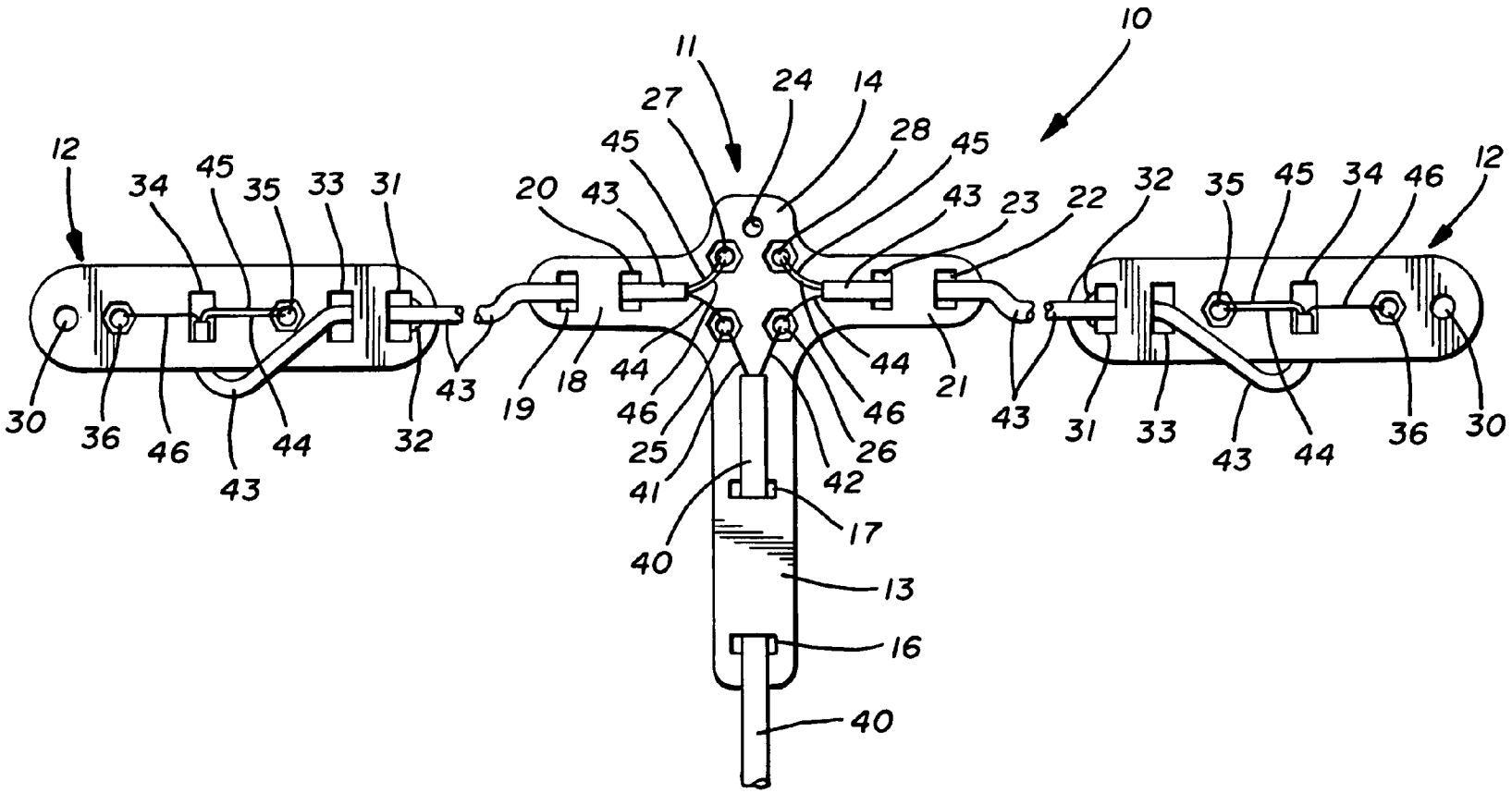
FIG. 3 is a somewhat schematic representation of the manner in which the bracket shown in FIG. 1 combines with two of the brackets shown in FIG. 2 to carry the wires forming a center fed half wire dipole antenna of the present invention.

A center fed half wave dipole antenna is somewhat schematically shown in FIG. 3 and indicated generally by the numeral 10. The wires of antenna 10 are supported and interconnected by a system of brackets including a center bracket, generally indicated by the numeral 11, and two identical end brackets generally indicated by the numeral 12. Brackets 11 and 12 are preferably made of an insulating plastic or like material such as glass filled nylon.

Figure 1:
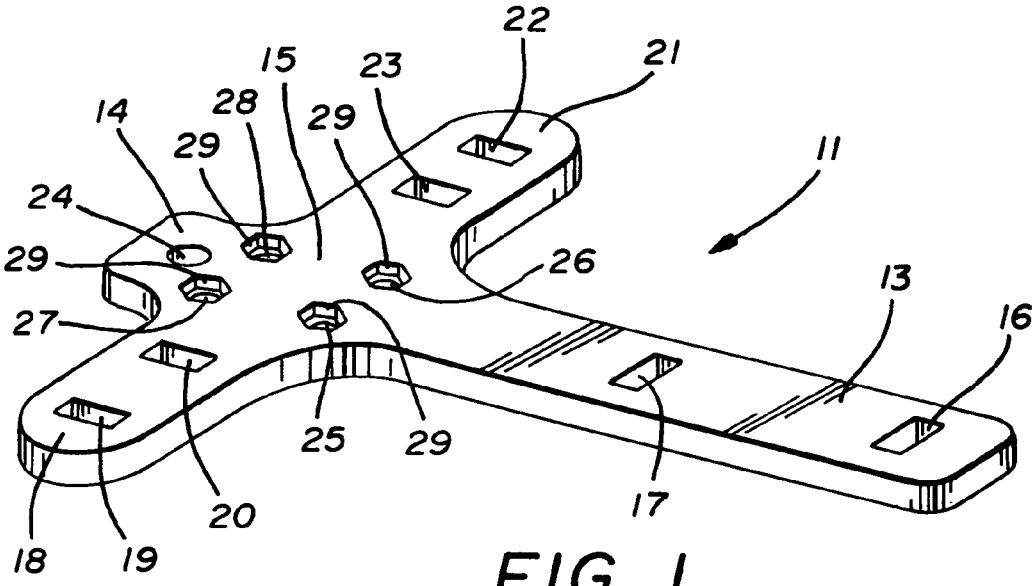
FIG. 1 is a perspective view of the center bracket of the antenna system of the present invention.
Figure 2:
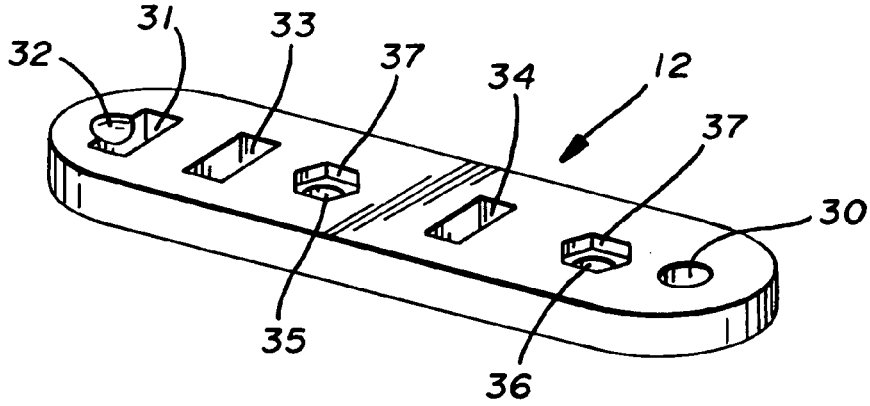
FIG. 2 is a perspective view of an end bracket of the antenna system of the present invention.

As best shown in FIG. 1, center bracket 11 is somewhat cross-shaped in configuration having an elongate base 13, a head 14, and a crossarm 15 between base 13 and head 14. Base 13 includes two spaced slots 16, 17 extending therethrough. Similarly, end 18 of crossarm 15 is provided with top spaced slots 19, 20 extending therethrough, and likewise end 21 of crossarm 15 is provided with two spaced slots 22, 23 extending therethrough. Head 14 has an aperture 24 extending therethrough, and the junction of crossarm 15 and base 13 is provided with a plurality of apertures 25, 26, 27, 28 therethrough. Each aperture 25-28 has a hex-shaped countersink 29 formed therein.

Each end bracket 12 is shown as being generally oval in configuration having an aperture 30 therethrough at one end thereof, and a slot 31 therethrough at the other end thereof. Slot 31 may be provided with a notch 32 if desired. Two additional slots 33, 34 are spaced from each other and from slot 31 and extend through bracket 12. An aperture 35 is positioned between slots 33 and 34, and an aperture 36 is positioned between slot 34 and aperture 30. Apertures 35 and 36 may be provided with a hex-shaped countersink 37 formed therein.

The manner in which brackets 11 and 12 carry the wires of a center fed half wave dipole antenna 10 is schematically shown in FIG. 3. A feed line 40, preferably in the form of a 300 ohm ladder line, for example, extends from a transceiver (not shown) and passes downwardly through slot 16 and then upwardly through slot 17. As will be evident, such provides a strain relief for feed wires 41 and 42 of feed line 40 when they are connected to bracket 11. In that regard, connection terminals are formed at apertures 25 and 26 of bracket 11. In fact, such terminals are also formed at apertures 27, 28, 35 and 36. These terminals (not shown) include, for example, a bolt, washers, nuts and the like and are intended to hold wires such that one wire held at a terminal electrically communicates with one or more other wires held by the terminal. Thus, feed wire 41 is attached to the terminal at aperture 25 and feed wire 42 is attached to the terminal at aperture 26.

The dipole lines which extend from bracket 11 to brackets 12 are essentially identical and include a line 43 which can simply carry one dipole wire out to brackets 12, or if antenna 10 is known as a "folded" dipole antenna, lines 43 can carry a plurality of wires wherein the signal goes out from bracket 11 to brackets 12, back from brackets 12 to bracket 11, and back out from bracket 11 to brackets 12, etc. Such is advantageous in that one can achieve the performance of a half wave dipole in a smaller space.

For demonstrative purposes, lines 43 are shown as carrying three wires 44, 45 and 46. Wire 44 of one line 43 is attached to the terminal at aperture 25, and wire 44 of the other line 43 is attached to the terminal at aperture 26. Wires 45 and 46 of one line 43 are attached to the terminal at aperture 27, and wires 45 and 46 of the other line 43 are attached to the terminal at aperture 28.

One line 43 extends downwardly through slot 20 and upwardly through slot 19 and then extends to one bracket 12 which could be several feet away. The other line 43 extends downwardly through slot 23 and upwardly through slot 22 and then extends to the other bracket 12 which likewise could be several feet away. Such provides strain relief for the connection at the terminals at apertures 25-28.

Similarly, strain relief is provided at the other end of each line 43 where it connects to bracket 12. To that end, each line 43 extends downwardly through slot 31 of a bracket 12 back upwardly through slot 33 of a bracket 12. Line 43 then extends around the side and under bracket 12 and up through slot 34 thereby providing strain relief for wires 44, 45 and 46 as they are attached to the terminals at apertures 35 and 36 as now to be described. Thus, wires 44 and 45 are shown as being connected to the terminal at aperture 35 of each bracket 12 and wire 46 is attached to the terminal at aperture 36.

As a result of these connections, when, for example, a signal is fed down feed wires 41, 42 from a transmitter, it is fed to wires 44 and then from the area of bracket 11 to brackets 12 where wires 44 are connected to wires 45. The signal then goes back to bracket 11 on wires 45 where wires 45 are connected to wires 46. The signal then goes out wires 46 toward brackets 12 to terminate at the terminals formed at apertures 36. Thus, in a single space of a specified length between bracket 11 and bracket 12, three times that specified length of wire is created.

Antenna 10 may be suspended at a desired height by a messenger line (not shown) which can be fed through apertures 30 of bracket 12 and aperture 24 of bracket 11. The ends of the messenger line may then be affixed to an appropriate structure, and antenna 10 is suspended at the desired height without putting any stresses any of the wires 41, 42, 44, 45 and 46. Alternatively, brackets 11 and 12 can be attached to appropriate structures by extending fasteners through apertures 24 and 30 to attach the brackets 11 and 12 at the desired height.

What is claimed is:

1. A dipole antenna system to mount a feedline comprising a center bracket having first, second, third, and fourth electrically isolated bracket terminals; a first end bracket having first and second electrically isolated end terminals; a second end bracket having first and second electrically isolated end terminals; a feed line having a first feed wire and a second feed wire, said first feed wire being coupled to said first bracket terminal, and said second feed wire being coupled to said third bracket terminal; a first dipole line having first, second, and third dipole wires, said first dipole wire of said first dipole line being connected between said first end terminal of said first end bracket and said first bracket terminal, said second dipole wire of said first dipole line being connected between said first end terminal of said first end bracket and said second bracket terminal, and said third dipole wire of said first dipole line being connected between said second end terminal of said first end bracket and said second bracket terminal; and a second dipole line having first, second, and third dipole wires, said first dipole wire of said second dipole line being connected between said first end terminal of said second end bracket and said third bracket terminal of said center bracket, said second dipole wire of said second dipole line being connected between said first end terminal of said second end bracket and said fourth bracket terminal, and said third dipole wire of said second dipole line being connected between said second end terminal of said second end bracket and said fourth bracket terminal.

2. The dipole antenna system of claim 1, wherein said center bracket includes an elongate base; a head; and a crossarm disposed between said base and head, said crossarm having a first and a second end; said crossarm having a first and a second pair of spaced slots, said first and second pair of spaced slots respectively disposed at said first and at said second end of said crossarm.

3. The dipole antenna system of claim 2, wherein said center bracket further includes a third pair of spaced slots disposed in said elongate base.

4. A dipole antenna system adapted for coupling to a feed line, said antenna system comprising a center bracket having at least two electrically isolated bracket terminals; a first and a second end bracket, each said end bracket having at least one electrically isolated end terminal, and a notched slot; a first dipole line extending between one said bracket terminal of said center bracket and said end terminal of said first end bracket; and a second dipole line extending between the other said bracket terminal of said center bracket and said end terminal of said second end bracket; wherein said dipole lines pass through said slots and said notches of said end brackets.

5. The dipole antenna system of claim 4, wherein said center bracket includes an elongate base; a head; and a crossarm disposed between said base and head, said crossarm having a first and a second end; said crossarm having two spaced slots at said first and at said second end to receive said dipole lines.

6. The dipole antenna system of claim 5, wherein said elongate base includes at least two spaced base slots to receive the feed line.

7. A dipole antenna system comprising a first and a second dipole line; a center bracket; a first end bracket and a second end bracket, said first and second end brackets including first and second spaced slots disposed at one end of each said end brackets, an aperture at the opposite end of each end bracket, and a notch disposed in one of said spaced slots; wherein said first end bracket is coupled to said center bracket by said first dipole lines and said second end bracket is coupled to said center bracket by said second dipole line, and wherein said first and second dipole lines pass downward through said first slot, and upward through said second slot.

8. The dipole antenna system of claim 7, wherein said center bracket is cross-shaped.

9. The dipole antenna system of claim 8, wherein said cross-shaped center bracket includes an elongate base; a head; and a crossarm disposed between said base and head, said crossarm having a first and a second end, and having a first and a second pair of spaced slots, said first pair of slots being disposed at said first end and said second pair of slots being disposed at said second end of said crossarm to receive said dipole lines, wherein said first dipole line and said second dipole line pass downward through one slot of each pair of slots and upward through the other slot of each pair of slots.

10. The dipole antenna system of claim 9, wherein said elongate base includes a third pair of spaced slots.

11. The dipole antenna system of claim 7, wherein said center bracket is formed from non-conductive insulating material.

12. The dipole antenna system of claim 7, wherein said first and second end brackets are formed non-conductive insulating material.

* * * * *